US012043920B2

(12) United States Patent
Angelico

(10) Patent No.: US 12,043,920 B2
(45) Date of Patent: Jul. 23, 2024

(54) MULTI-ROW COAXIAL MELT-BLOWN SYSTEM

(71) Applicant: FRATELLI CECCATO MILANO S.R.L., Milan (IT)

(72) Inventor: Giuseppe Angelico, Teramo (IT)

(73) Assignee: FRATELLI CECCATO MILANO S.R.L., Milan (IT)

( * ) Notice: Subject to any disclaimer, the term of this patent is extended or adjusted under 35 U.S.C. 154(b) by 0 days.

(21) Appl. No.: 17/807,043

(22) Filed: Jun. 15, 2022

(65) Prior Publication Data

US 2022/0403556 A1 Dec. 22, 2022

(30) Foreign Application Priority Data

Jun. 21, 2021 (IT) ..... 102021000016130

(51) Int. Cl.
*D01D 4/02* (2006.01)
*D01D 5/098* (2006.01)

(52) U.S. Cl.
CPC ..... *D01D 4/025* (2013.01); *D01D 5/0985* (2013.01)

(58) Field of Classification Search
CPC ..... D01D 5/0985; D01D 4/025; D01D 5/098; D01D 4/04
See application file for complete search history.

(56) References Cited

U.S. PATENT DOCUMENTS 2,835,925 A * 5/1958 Proctor ..... D01D 1/06 264/331.19
2,841,821 A * 7/1958 Phipps ..... D01D 4/08 425/192 R
3,242,529 A * 3/1966 Parr ..... D01D 5/08 425/72.2
3,280,424 A * 10/1966 Heijnis ..... D01D 5/092 264/211.14
3,891,379 A * 6/1975 Lenk ..... D01D 4/08 425/464
4,801,257 A 1/1989 Lenk
4,875,846 A * 10/1989 Reinbold ..... D01D 1/06 425/464

(Continued)

FOREIGN PATENT DOCUMENTS

CN 205711071 U 11/2016
CN 111534866 A 8/2020

*Primary Examiner* — Emmanuel S Luk
(74) *Attorney, Agent, or Firm* — Vorys, Sater, Seymour and Pease LLP

(57) ABSTRACT

Multi-row coaxial melt-blown system including support including first duct to convey polymeric fluid parallel to a delivery direction and second duct to convey air or gas, a box removably constrained to the support and including acceleration ducts parallel delivery direction including tubing in fluid connection with first duct to distribute the fluid, first holes parallel the delivery direction, centred and spaced relative to acceleration ducts along the delivery direction to house each part of a respective tube, second holes parallel the delivery direction for air or gas passage, and a slit extending transversely to the delivery direction between the acceleration ducts and the first holes in fluid connection with the second holes. The support includes a housing to contain the box and the slit extends in the box from side to side in fluid connection with the second duct to convey air or gas from second duct to second holes.

6 Claims, 6 Drawing Sheets

(56) References Cited

U.S. PATENT DOCUMENTS

| | | | | |
|---|---|---|---|---|
| 9,303,334 | B2 * | 4/2016 | Brown | D01D 4/027 |
| 2011/0037194 | A1 | 2/2011 | James | |
| 2014/0353882 | A1 * | 12/2014 | Joo | D01D 5/34 425/174.8 R |
| 2016/0047075 | A1 * | 2/2016 | Foley | D01D 5/0084 425/174.8 E |

* cited by examiner

MULTI-ROW COAXIAL MELT-BLOWN SYSTEM

The present invention has as its object a multi-row coaxial melt-blown system of the type specified in the preamble to the first claim.

In other words, the present invention has as its object a system for making extruded polymer filaments intended to directly or indirectly produce non-woven type fabric, also known as TNT.

As is well known, nonwoven fabric, or TNT, is an industrial product similar to a textile but obtained by processes other than weaving and knitting. Therefore, within a non-woven fabric, the fibres present a random pattern, without the identification of any ordered structure, whereas in a woven fabric, the fibres present two prevailing and orthogonal directions, usually called warp and weft.

At present, a plurality of products containing TNT are produced, depending on the manufacturing technique used, which is mainly connected to the use of the product itself.

A distinction is made, in particular, between high quality non-woven fabrics for hygienic products and low quality non-woven fabrics used mainly for geotex.

Figure 6:
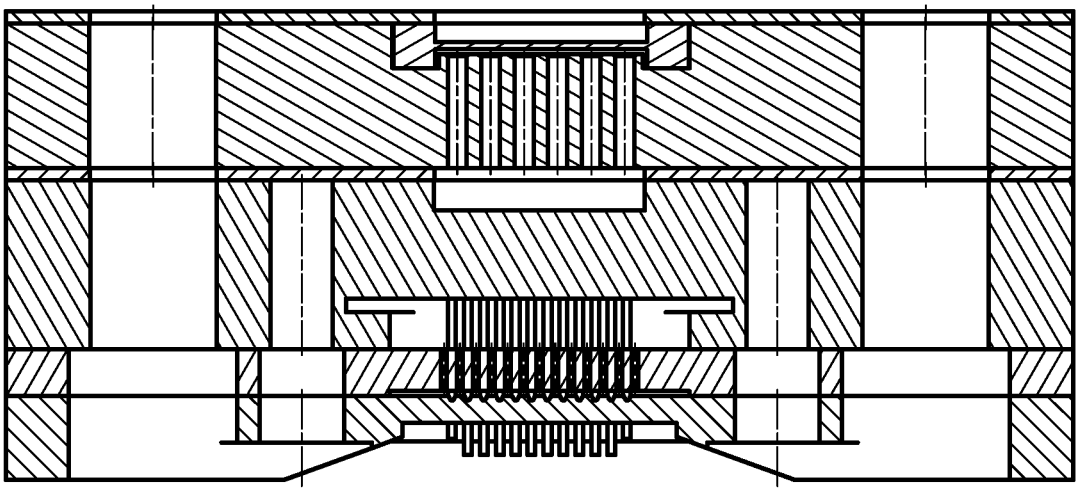
Fig. 6 (Prior Art)
Figure 7:
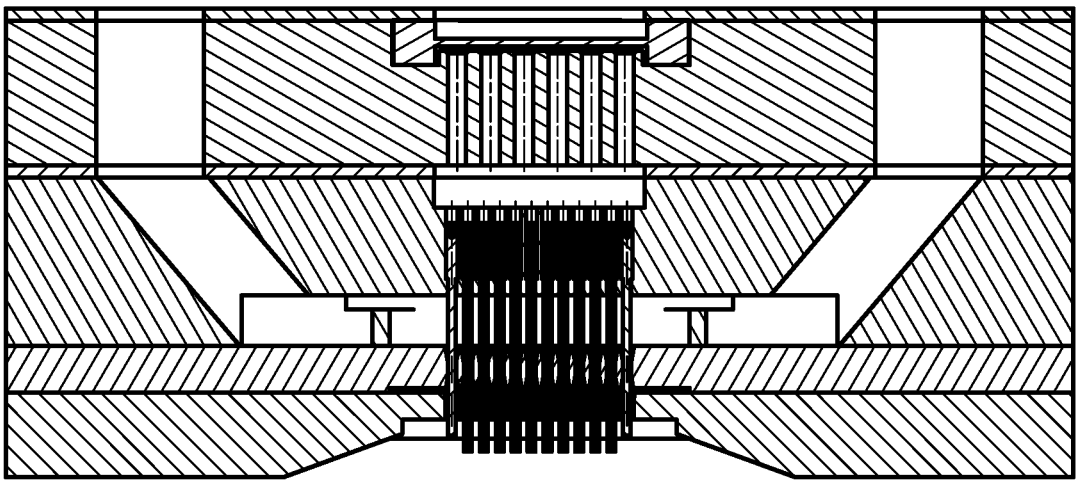
Fig. 7 (Prior Art)
Figure 8:
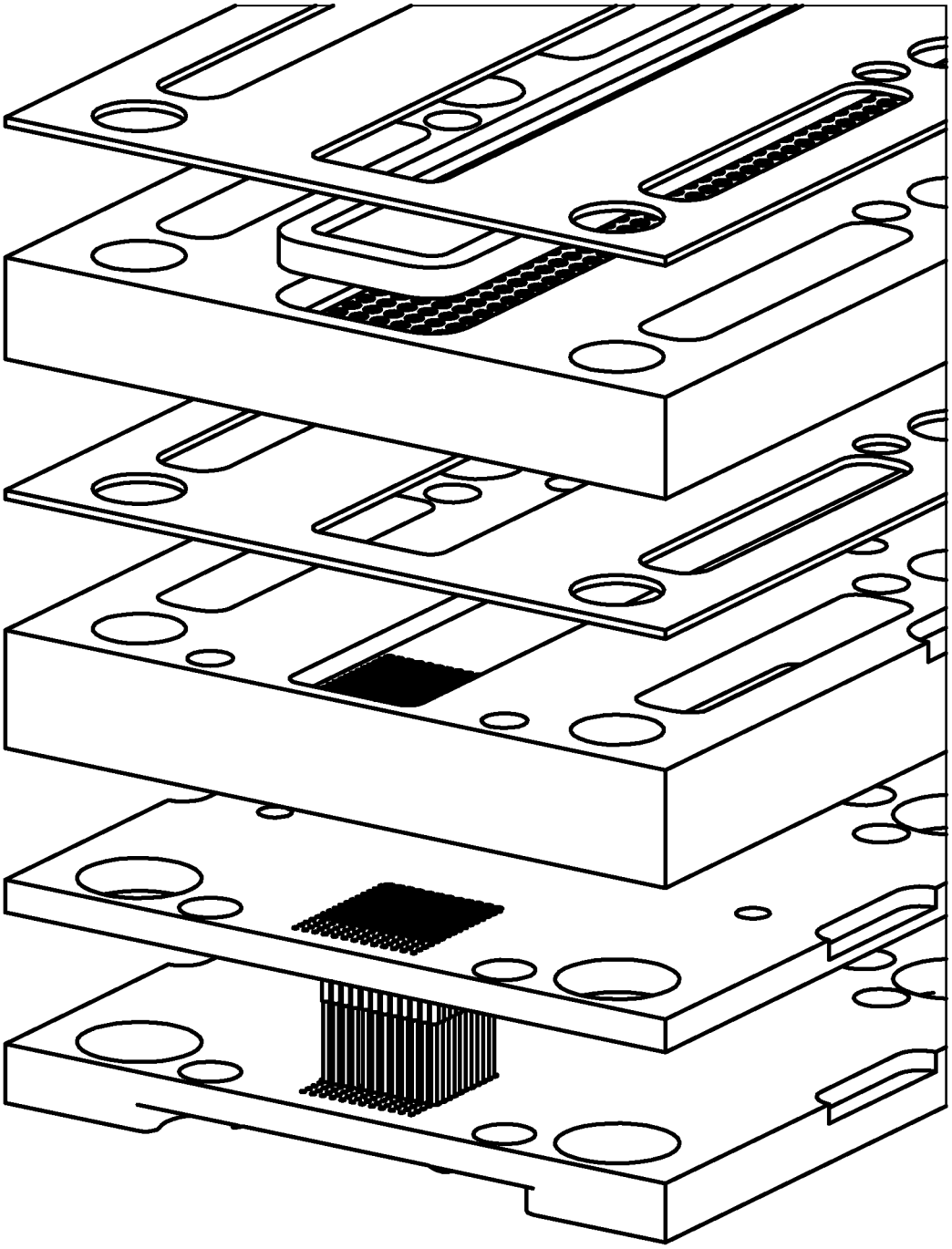
Fig. 8 (Prior Art)

From a technical point of view, nonwoven fabrics, also known by the anglophone term nonwoven fabric, can basically be subdivided into spunlace, spunbond and melt-blown. Within the melt-blown technology, in particular, the multirow coaxial melt-blown, or multirow coaxial melt-blown, systems are known. An example of such systems is shown in FIGS. 6-8.

In general, such systems involve the stretching of polymer coming out of tubes, arranged in rows, through air that coaxially passes from outside the tube and pushes the fibre downwards.

In particular, multi-row coaxial melt-blown systems comprise components defining coaxial holes, arranged in rows, capable of housing at least part of said coaxially passing tubes within the holes in such a way as to allow diffusion of polymeric fluid and, at the same time, to allow diffusion of air or gas from at least part of the holes.

Usually, such systems include apparatuses, called spin packs, comprising a plurality of different components capable of interacting with each other. Usually, a spin pack consists of a spinneret and a diffusion device including one or more components called air plates.

In addition, the spinneret may at the same time be connected to a taper and/or a breaker-plate.

If present, the breaker-plate is, at the same time, also connected to an extrusion head capable of conveying at least polymeric fluid and possibly also pressurised air or gas to the spin pack. The breaker-plate and taper have basically the same characteristics as the breaker-plate and taper used in spunbond and melt-blown technologies.

The multi-row coaxial melt-blown systems including spin spacks, however, do not include a diffusion device including a support to support an air blade, do not include a cusp or do not have a simple die that only allows polymer to escape.

In multi-row coaxial melt-blown systems, the spinneret is essentially a support that enables tubes to be supported to expel polymer filaments. The diffusion device is, therefore, attached to the spinneret and comprises an intermediate plate, or air plate, capable of allowing the passage of said tubes and also the exit of air or other pressurised gas, and an external mask, or external air plate, usually of divergent form, from which the polymer filament exits, pushed downwards by the air, before reaching the conveyor belts present in any system for the production of non-woven fabric.

The multi-strand coaxial melt-blown devices include some major drawbacks.

In particular, in order to make a melt-blown non-woven fabric, it is necessary for the tubes to pass through the support, the plate and the outer mask without losing coaxiality with respect to the holes made, in particular, on the plate and mask in order to ensure proper operation of the system. In fact, it is possible that the ends of the tubes coming out of the external mask through the holes, which are configured with a larger diameter than the tubes so as to also allow air or gas to flow out, undergo deformations. This is mainly due to the need to maintain at least one slit between the plate and the outer mask for gas or air distribution.

In addition, the systems as just described have several overlapping plates and are not very compact and difficult to dismantle.

The use of many plates, in the installation phase, leads to considerable problems once the installations have undergone multiple processing. In fact, it is necessary for the plates and masks to fit all the tubes perfectly, and it is also necessary for the plate and external mask to be perfectly aligned with each other so as to avoid unwanted overlaps that could lead to broken tubes or the impossibility of fitting the intermediate and external air plates to the internal air plate.

These problems are extremely amplified by the high processing temperatures and the expansion that can occur in the various components of multi-row coaxial melt-blown systems.

In addition, all of the aforementioned problems are greatly amplified when the spin pack is particularly large, since assembling or disassembling the air plate from the tubes can result in the need to greatly increase the force required to overcome the mutual friction between air plate and tubes.

In this situation, the technical task underlying the present invention is to devise a multi-row coaxial melt-blown system capable of substantially obviating at least part of the aforementioned drawbacks.

Within the context of said technical task, it is an important scope of the invention to obtain a multi-row coaxial melt-blown type system capable of facilitating the assembly and disassembly of one or more components of the system.

Another important aim of the invention is therefore to achieve a system whose maintenance is simple, rapid, effective and economical.

In conclusion, a further task of the invention is to realise a system which is extremely versatile and which allows the conformation, understood for example as density or number, of the tubes from which the polymer filaments emerge to be easily modified.

The specified technical task and purposes are achieved by a multi-strand coaxial melt-blown system as claimed in the annexed claim 1.

Preferred technical solutions are highlighted in the dependent claims.

Figure 1:
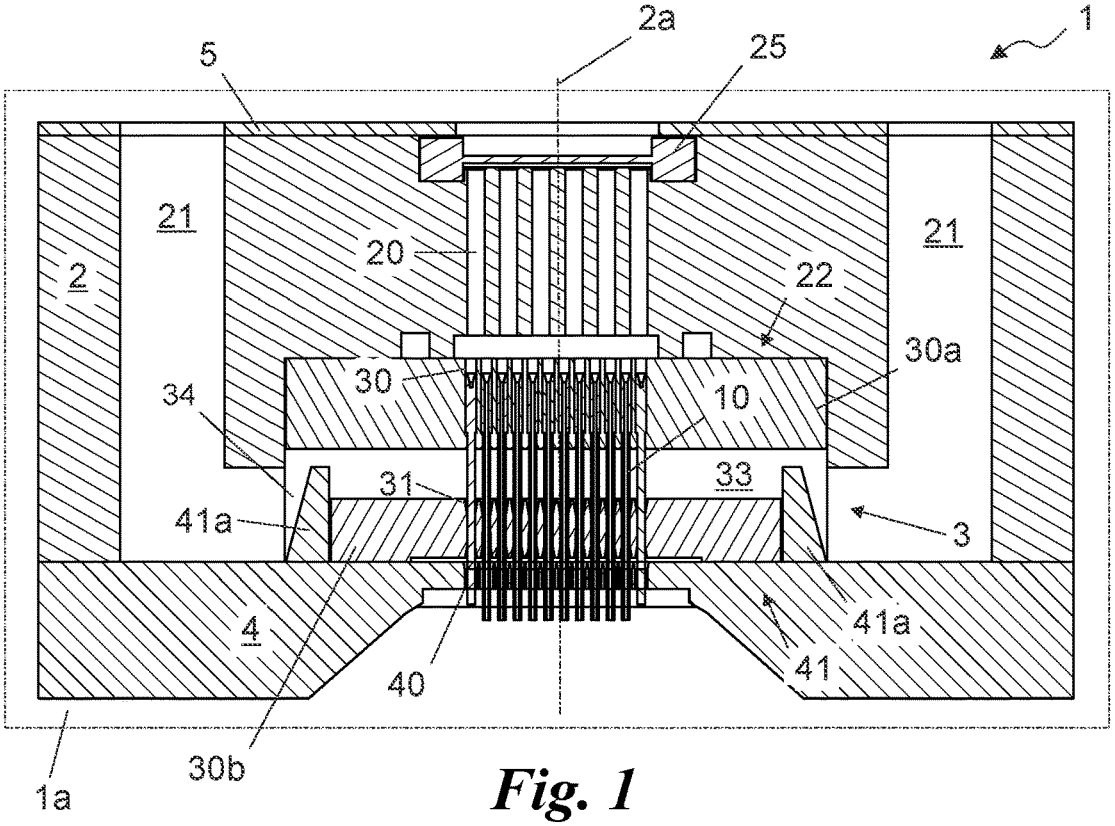
Figure 2:
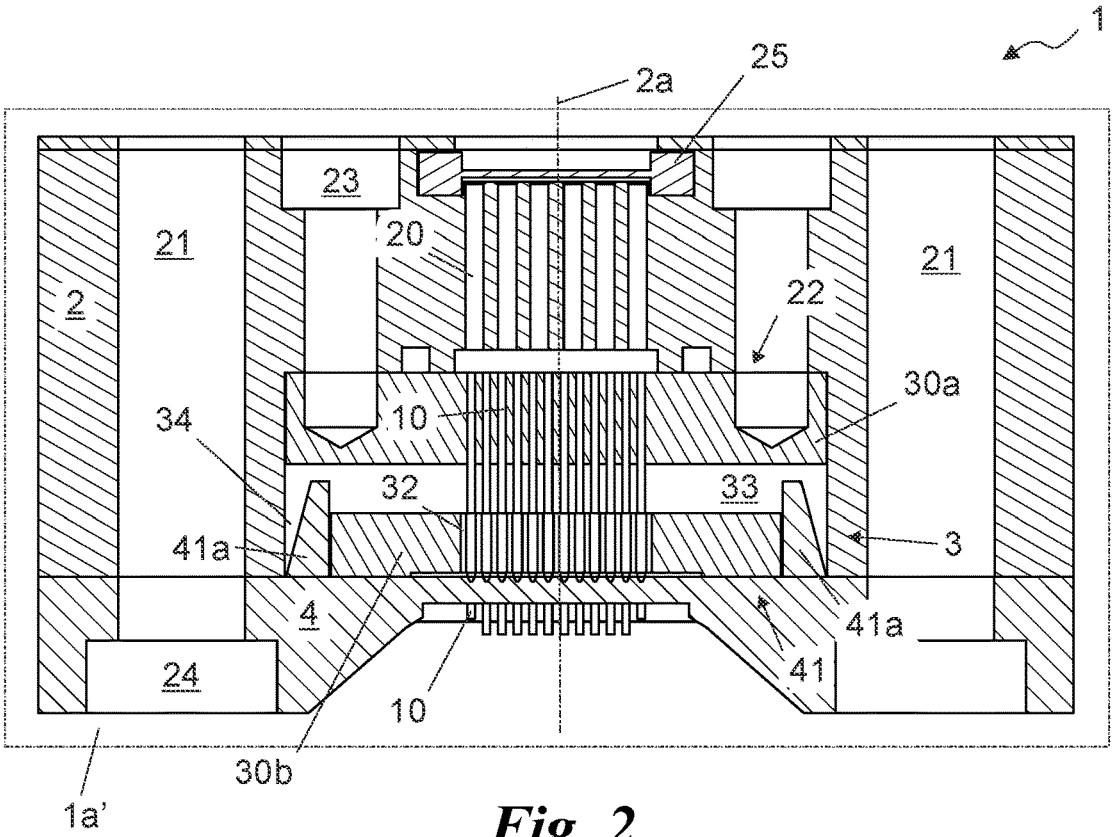
Figure 3:
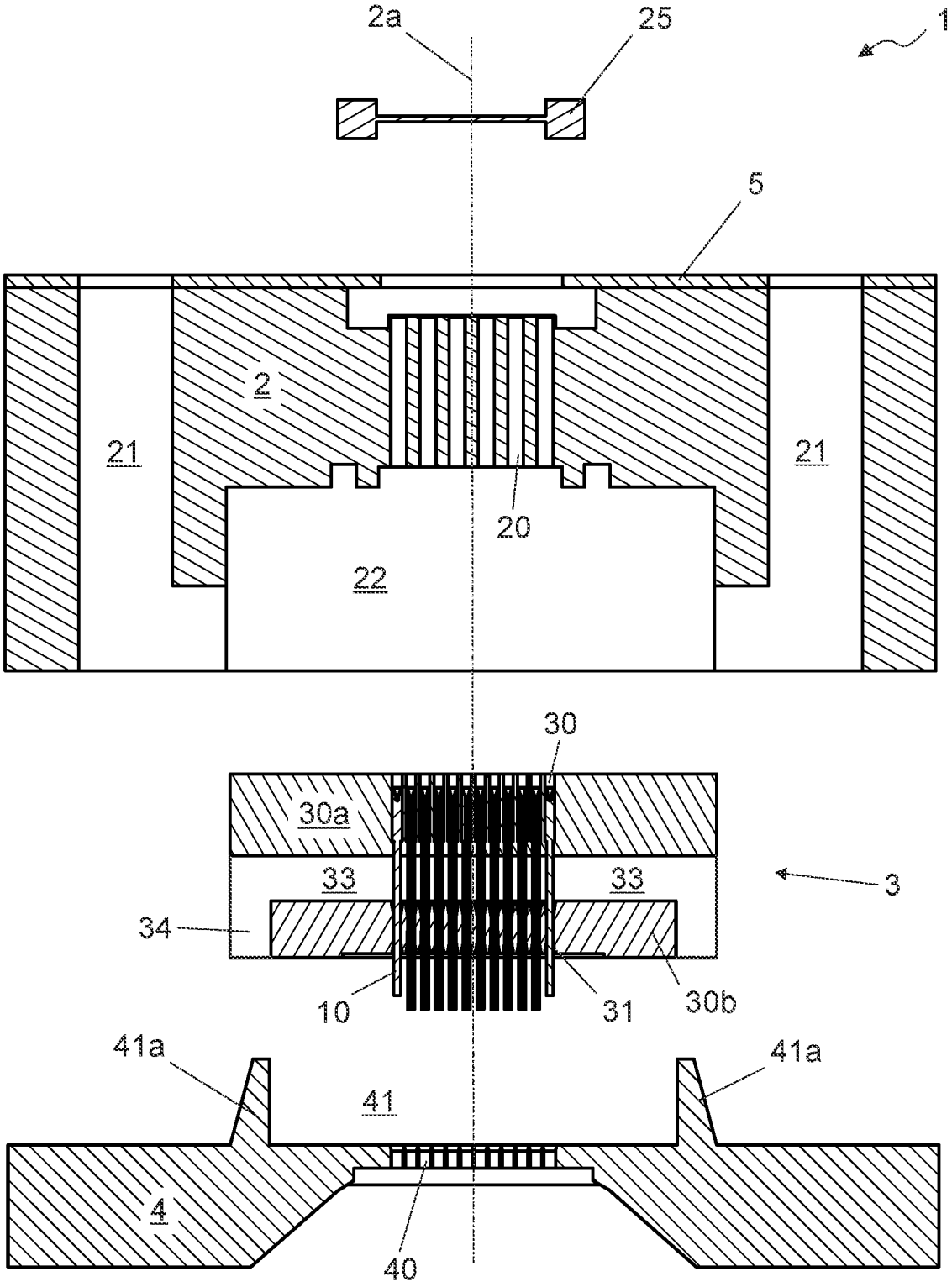
Figure 4:
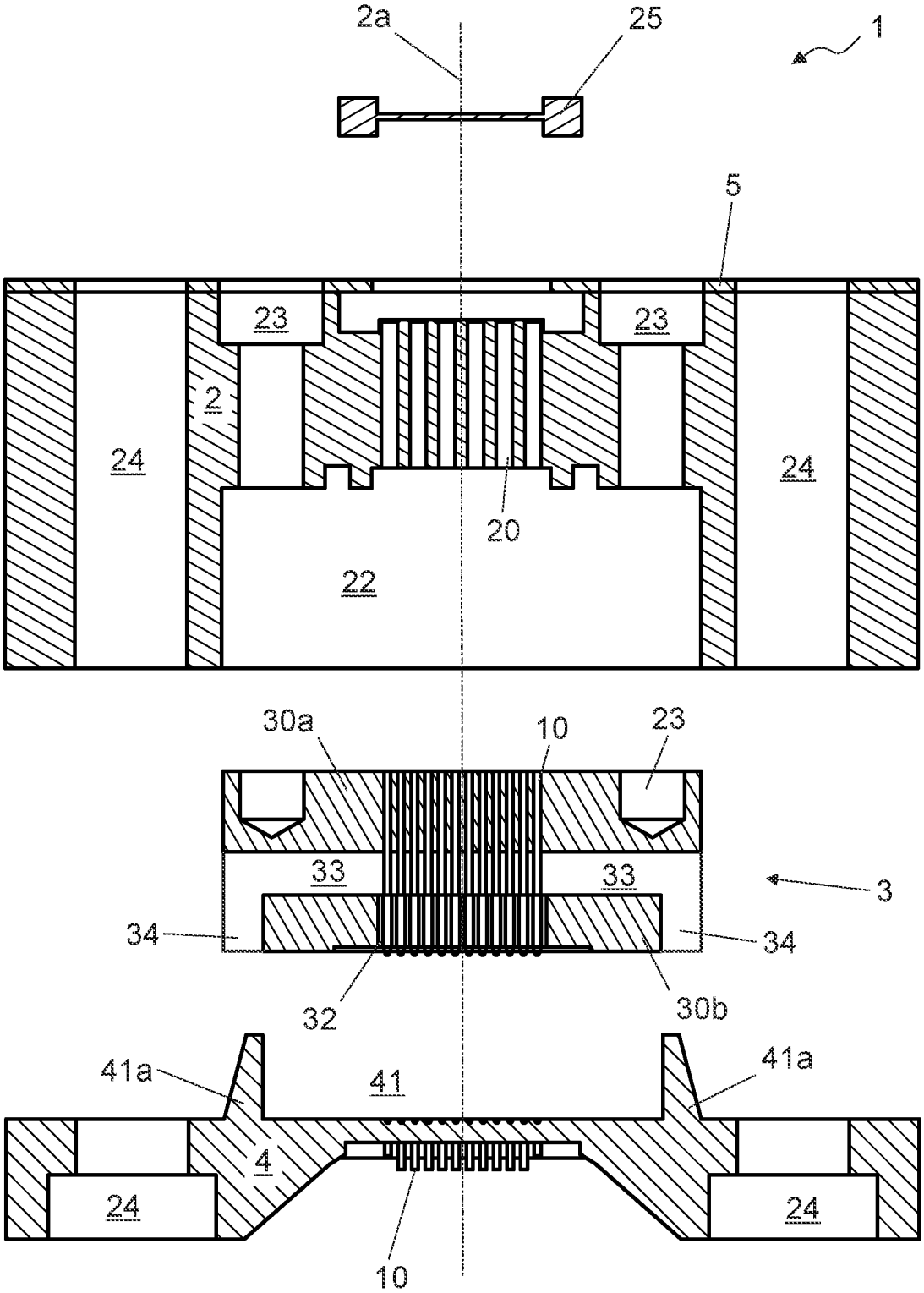
Figure 5:
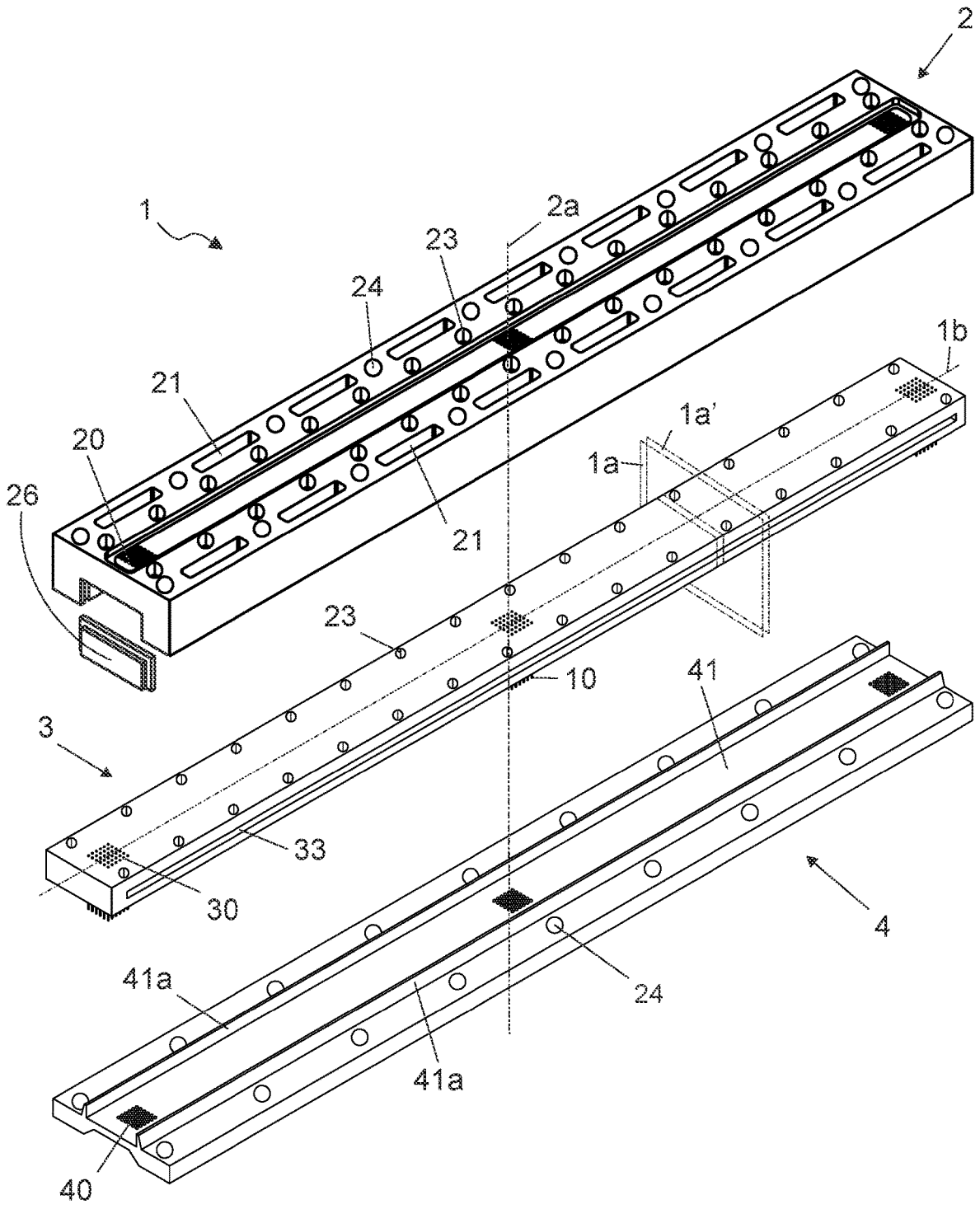

The features and advantages of the invention are hereinafter clarified by the detailed description of preferred embodiments of the invention, with reference to the accompanying drawings, wherein:

the FIG. 1 illustrates a cross-sectional view along the main plane of a multi-row coaxial melt-blown system according to the invention in which the system is assembled and the section shows the first holes in detail;

the FIG. 2 illustrates a cross-sectional view along the secondary plane of a multi-row coaxial melt-blown system according to the invention wherein the system is assembled and the section shows the second holes and the constraining means in detail;

the FIG. 3 is an exploded view of the system of FIG. 1;

the FIG. 4 is an exploded view of the system of FIG. 2;

the FIG. 5 illustrates an exploded and perspective view of a multi-row coaxial melt-blown system according to the invention;

the FIG. 6 illustrates a cross-sectional view of a multi-row coaxial melt-blown system of the known invention in which the holes of the intermediate air plate through which air flows are highlighted;

the FIG. 7 is a further cross-sectional view of a multi-row coaxial melt-blown type system of the known technique in which are evidenced the holes of the intermediate air plate through which the air flows; and the FIG. 8 is an exploded and perspective view of a multi-row coaxial melt-blown system of the known technique showing, from bottom to top, an outer air plate, an intermediate air plate, an inner air plate, a taper, a breaker plate and a second taper intended to be constrained in contact with an extrusion head.

In the present document, the measurements, values, shapes and geometric references (such as perpendicularity and parallelism), when associated with words like "about" or other similar terms such as "approximately" or "substantially", are to be considered as except for measurement errors or inaccuracies due to production and/or manufacturing errors, and, above all, except for a slight divergence from the value, measurements, shape, or geometric reference with which it is associated. For instance, these terms, if associated with a value, preferably indicate a divergence of not more than 10% of the value.

Moreover, when used, terms such as "first", "second", "higher", "lower", "main" and "secondary" do not necessarily identify an order, a priority of relationship or a relative position, but can simply be used to clearly distinguish between their different components.

Unless otherwise specified, as results in the following discussions, terms such as "treatment", "computing", "determination", "calculation", or similar, refer to the action and/or processes of a computer or similar electronic calculation device that manipulates and/or transforms data represented as physical, such as electronic quantities of registers of a computer system and/or memories in, other data similarly represented as physical quantities within computer systems, registers or other storage, transmission or information displaying devices.

The measurements and data reported in this text are to be considered, unless otherwise indicated, as performed in the International Standard Atmosphere ICAO (ISO 2533:1975).

With reference to the figures, the multi-row coaxial melt-blown system according to the invention is globally referred to as number 1.

The system 1, as per the title, includes some features of common melt-blown systems and other special features.

The device 1 is configured for use within a multi-row coaxial melt-blown system.

The installation, as per the title, includes some features of common melt-blown installations and other special features.

In particular, the system 1 preferably includes at least one support 2 and one box 3.

The subsequent description of all components that may be present in a system 1 is made by considering them along a cross-section of the system in a main plane 1*a*, or a secondary plane 1*a*' parallel to the main plane 1*a*, as depicted for example in FIGS. 1-2. Naturally, such an installation 1 and its component parts also extend along a longitudinal direction 1*b* perpendicular to the main plane 1*a* and the secondary plane 1*a*', or rather the aforementioned cross-sections.

Thus, essentially, the main plane 1*a* and secondary plane 1*a*' of the section are mutually offset planes along the longitudinal direction 1*b*.

The support 2 performs substantially the same functions as an ordinary breaker plate.

Thus, the support 2 is essentially an attachment device on which the other components of the system 1 are laid.

Substantially, support 2 is the main connecting element between the components of the system and the external apparatuses capable of supplying the system with substances used in the normal operation of the system 1 itself.

For example, among the various apparatuses external to the system 1, there may be an apparatus capable of supplying the system with polymeric fluid under pressure, or a pneumatic apparatus capable of supplying the system with pressurised air or gas, or others.

Among the external apparatus, in detail, there may be an extrusion head.

The extrusion head, as is known, usually includes at least one main channel.

The main channel is preferably designed to allow a first polymeric fluid to pass through the extrusion head. Such fluid may be fed into the box by an apparatus external to the system.

Preferably, as is the case within common melt-blown systems, the main channel is suitable for allowing the passage of hot polymeric fluid having temperatures of about 180°. In fact, for example, the polymeric fluid may be polypropylene, polyester, nylon, cellulose, viscose or other fluids suitable for the production of non-woven fabrics, or TNT, with the coaxial, multi-row melt-blown system.

In addition, the extrusion head may also comprise a secondary channel.

The secondary channel is preferably designed to allow gas to pass through the extrusion head. Again, gas may flow to the system from apparatuses outside the system.

Preferably, the support 2 comprises one or more first ducts 20. Preferably, the support 2 comprises a plurality of first ducts 20. The first ducts 20 are substantially configured to convey polymeric fluid. Thus, the first ducts 20 are adapted to allow passage of a first polymeric fluid through the support 2. Such fluid may be fed into the support 2 by an apparatus external to the system.

Preferably, the first ducts 20 are apt to be arranged in fluid passage connection, for example, with the main channel of the extrusion head so as to receive polymeric fluid therefrom.

The one or more first ducts 20, in even greater detail, are configured to convey the polymeric fluid along or parallel to a delivery direction 2*a*.

The delivery direction 2*a* is substantially a vertical direction, preferably perpendicular to the ground or to a roller on which the polymeric filaments making the nonwoven fabric may be deposited. Therefore, the delivery direction 2*a* preferably extends in one of the planes 1*a*, 1*a*' and is, in general, transverse to the longitudinal direction 1*b*.

Furthermore, the support 2 may also comprise at least one second duct 21.

The second duct 21 is preferably configured to convey air or gas and is therefore suitable for allowing gas to pass through the support 2. Again, gas may flow to the system 1 from apparatus outside the system.

For example, the second duct 21 may be in fluid passage connection with the secondary duct of the extrusion head.

The support 2 may include additional elements.

For example, the support 2 may include filtering means 25.

The filtering means 25, if present, are preferably arranged upstream of the first ducts 20 in such a way as to filter the polymeric fluid.

The filtering means 25, in particular, may include a common flat filter, substantially a mesh suitable for filtering the first polymeric fluid, or may include a porous element. The system 1 may also include a taper 5. The taper 5, if present, is detachably constrained to the system 2.

In particular, the taper 5 is substantially a connecting element between the support 2 and any apparatus external to the system 1. The taper 5 may, therefore, be positioned between the support 2 and the extrusion head.

In any case, the support 2 may include first constraint means 23.

The first constraint means 23 are preferably configured to allow the support 2 to be constrained to an external apparatus, for example the extrusion head, or even to the box 3 itself. Alternatively, the first constraining means 23 may allow the binding of the support 2 to a taper 5.

The first constraining means 23 may be realised with conventional couplings such as, for example, screws and bolts or other resolvable joints, or even magnetic connectors as long as they allow stable constraint between external apparatus, such as the extrusion head, or taper 5 and support 2.

Furthermore, support 2 preferably also includes second constraint means 24.

The second means of constraint 24 are configured to allow the constraint of the support 2 with another component of the system 1, as further specified below.

The second constraint means 24 may be conventional and may be substantially of the same type as the first constraint means 23.

Furthermore, advantageously, the second constraint means 24 are preferably accessible at an opposite side of the support 2 with respect to said first constraint means 23.

This feature implies that the support 2 may advantageously be coupled to components on both sides at different times without the use of the first constraining means 23 obstructing, for example, the use of the second constraint means 24 and vice versa.

The box 3 is preferably removably constrained to the support 2.

The box 3 is substantially a beam element extending predominantly along or parallel to the longitudinal direction 1*b*, i.e. a direction transverse to the delivery direction 2*a* and preferably perpendicular to the plane 1*a* or 1*a'*.

The box 3, even more in detail, is substantially the assembly of a first portion 3*a* assimilable to a conventional inner air plate, or spinneret, and a second portion 3*b* assimilable to a conventional intermediate air plate. In other words, box 3 is, on the whole, a portion of a spin pack in which the outer air plate is not present.

In fact, the box 3 preferably includes a plurality of acceleration ducts 30. The acceleration ducts 30 are preferably arranged in the first portion 3*a*.

The acceleration ducts 30 are substantially configured to receive the first polymeric fluid from the first ducts 20. Therefore, preferably, the acceleration ducts are preferably arranged in fluid passage connection with the first ducts 20.

The acceleration ducts 30 extend parallel to the delivery direction 2*a*.

Furthermore, the acceleration ducts 30 are preferably configured to accelerate the first polymeric fluid.

In this regard, in multi-row coaxial melt-blown systems, the acceleration ducts include, or may comprise, tubes 10. Such tubing 10 may, therefore, be detachably constrained to the box 3.

The tubes 10 are widely known in the present state of the art and are essentially ducts including at least one internal convergent section capable of allowing acceleration of the first polymeric fluid transiting therein.

Furthermore, the tubes 10 have a substantially cylindrical tubular shape and define diameters usually between 0.6 and 1 mm.

The tubes 10 are, moreover, intended to extend through the box 3, as shown in FIGS. 1 and 3.

If the tubes 10 are not in one piece with the box 3, the support usually includes housings.

The housings may be substantially cavities, including at least one shoulder or step, within which the tube 10 may be housed at least partially.

The tube 10, at the same time, preferably includes a base and a stem.

The base is preferably configured to be inserted within one of the housings.

The stem preferably extends along the delivery direction 2*a*, or rather in a vertical direction along the cross-section. Therefore, the first polymeric fluid from the first ducts 20 substantially enters the base of the tubes 10 and is accelerated along the stems.

Thus, the tubes 10 are substantially in fluid passage connection with the one more first ducts 20 and are configured to distribute said polymeric fluid, The acceleration ducts 30 may then be distributed along one or more rows extending parallel to the longitudinal direction. In particular, they are usually distributed in such a regular manner as to make ordered rows both along the longitudinal direction and along each cross-section of the system 1.

Sometimes, the acceleration ducts 30 of the adjacent rows are mutually offset along the longitudinal direction in such a way as to realise a substantially chequered configuration.

The box 3 also includes first holes 31 and second holes 32. The latter are preferably arranged in the second portion 30i b.

The first holes 31 preferably extend along parallel to the delivery direction 2*a*. Furthermore, they are preferably centred and spaced with respect to the acceleration ducts 30 along the dispensing axis 2*a*. Thus, the first holes 31 are preferably configured to each accommodate part of a respective tube 10. The tubes 10, as mentioned above, are in turn configured to distribute polymeric fluid.

Therefore, either first holes 31 are designed to allow polymeric fluid to pass through the tubes 10.

The second holes 32 are, on the other hand, preferably separate from the first holes 30. They are, in particular, suitable for allowing the passage of air or gas. Alternatively, the second holes 32 could coincide with the first holes 31 and accommodate the tubes 10 by maintaining a gap externally to them to allow the passage of air or gas.

In general, the second holes 32 also extend parallel to the delivery direction 2*a*.

Therefore, essentially, the first holes 31 are adapted to accommodate part of the stem of the tubes 10. The latter are constrained to the box 3 in the first portion 30*a* and pass through the first holes 31 in the second portion 30*b*. The second holes 32, at the same time, are intended to allow the passage of air or gas.

The box 3 also includes a slit 33.

The slit 33 extends transversely to the delivery direction 2*a* between the acceleration ducts 30 and the first holes 31.

In other words, the acceleration ducts 30 and the first holes 31 are connected by the tubes 10 and separated by the slit 33 which is transverse to the same tubes 10. Thus, the slit 33 is in fluid passage connection with the second holes 32.

Advantageously, the slit 33 extends into the box 3 from side to side. This means that the slit 33 extends, in a plane transverse to the box extending parallel to the delivery direction 2*a*, the slit 33 starts at an opening on one side of the box 3 and ends at an opening on an opposite side of the box 3.

Thus, the support 2 advantageously comprises a housing 22. The housing 22 is substantially a groove made in the support 2 extending along the longitudinal direction 1*b*.

The housing 22 is also preferably open along at least one side along the longitudinal direction 1*b* so that the box 3 is removable and insertable by sliding, preferably along the longitudinal direction 1*b* and along the side comprising said opening. The said opening is also preferably re-closable by means of closing means such as, for example, an interlocking re-closable plate 26 or slideable in a direction perpendicular to the longitudinal direction 1*b*, or similar.

The housing 22 is configured to hold the box 33. Thus, the support 2 essentially embraces the box 3 when the latter is in use in the system 1. The box 3 essentially acts as an insert or cartridge insertable into the support 2. Preferably, therefore, the second duct 21 accesses the housing 22 transversely to the delivery direction 2*a*. In particular, the second duct 2 accesses the housing 22 transversely to the delivery direction 2*a* and the longitudinal direction 1*b*.

Thus, the slit 33 is in fluid passage connection with the second duct 21 and is also configured to convey air or gas from the second duct 21 to the second slits 32.

The system 1, in addition to what is described, could further include a mask 4. The mask 4 is mostly similar to a common external air plate with some differences.

Preferably, the mask 4 is removably constrained to one or more of the support 2 and the box 3. Preferably, the mask 4 is removably constrained to the support 2 by, for example, the second constraint means 24. Thus, the mask 4 acts as a cap that traps the box 3 in the housing 22 within the support 2.

Preferably, the mask 4 preferably includes a plurality of third holes 40.

The third holes 30 are preferably centred with respect to the first holes 31. Furthermore, they are capable of accommodating part of the tubes 10 from the first holes 31 of the box 3 and are communicating with the second holes 42. Thus, the third holes 40 accommodate part of the tubes 10 and, at the same time, allow air or gas to pass around the tubes 10. In other words, the third holes 40 are also in fluid passage connection with the second holes 32. In order to achieve this feature, it is sufficient for the third holes 40 to be oversized with respect to the tubes 10 so as to create a gap around the tubes 10 for the passage of air.

The mask 4 further comprises a seat 41.

The seat 41 is advantageously configured to accommodate the box 3. In this way, the mask 4 can be anchored to the box 3.

In more detail, preferably, the seat 41 is bounded by two side panels 41*a*. The two side panels 41*a* are advantageously positioned on opposite sides with respect to the delivery direction 2*a*. Thus, they protrude parallel to the delivery direction 2*a* and preferably extend parallel to the longitudinal direction 1*b*. Thus, the seat 41 also extends globally parallel to the longitudinal direction 1*b*.

The box 3 therefore comprises at least two fissures 34. The two fissures 34 are advantageously configured to accommodate the sides 41*a*. Thus, when the box 3 is placed on the mask 4, or vice versa, substantially the side rails 41*a* are introduced into the fissures 34 so that the box 3 is anchored to the mask 4.

The slots 34 extend into the box 3 preferably parallel to the delivery direction 2*a* at the ends through which the slit 33 passes.

The side panels 41*a*, in addition, preferably define a convergent shape with respect to the delivery direction 2*a*. Such a shape advantageously facilitates their introduction into the fissures 34 and, thus, also facilitates the alignment of the third holes 40 with the tubes 10 when the system 1 is being, for example, assembled.

The invention also comprises a conversion kit for a multi-row coaxial melt-blown type system. The kit comprises the system 1 and a plurality of boxes 3. Thus, the boxes 3 are replaceable within the housing 22. However, the boxes 3 include different quantities and/or different arrangements of the first holes 31, thus also including the tubes 10 and the second holes 31.

This means that, in contrast to systems of the known technique in which it is necessary to remove outer air plate, intermediate air plate and inner air plate, the system 1 allows the type of non-woven tissue reproducible with the system 1 to be changed by simply releasing the mask 4 from the holder 2 and replacing the box 3 in the housing 22.

Thus, the invention enables an innovative system 1 conversion process comprising at least one step of replacing the box 3.

Furthermore, the invention also comprises a novel procedure for assembling the system 1.

The process essentially includes at least one introduction step. In the introduction step, the box 3 is introduced into the housing 22 by arranging the fissure 33 in fluid passage connection with at least one second duct 21 and the tubes 10 in fluid passage connection with one or more first ducts 20.

The assembly procedure, in addition, may further include a positioning step.

In the positioning step, the box 3 is positioned in the seat 41. The positioning step may be equivalently carried out prior to introducing the box 3 into the housing 22 or even subsequently. Furthermore, the procedure may include a constraining step in which the mask 4 is constrained on the support 2. Preferably, the constraining step is realised with the second constraining means 24.

Furthermore, even more in detail, in the positioning step the side panels 41*a* are inserted into the fissure 34.

The invention also makes it possible to realise a novel cleaning procedure of the system 1.

Thus, the cleaning procedure comprises at least one step of removing the box 3 from the housing 22 and a step of investing the slit 33 with pressurised air. Thus, by investing the slit 33 with pressurised air, dust deposited within the slit 33 is also removed.

The system 1 according to the invention achieves important advantages.

In fact, the system 1 makes it possible to avoid losses of axiality between the tubes housed in part of the diffusion device and the holes made in the components of the system, since the cleaning of the box 3 can be carried out from the sides, through the slit 33, without the need to remove the tubes 10 from the first holes 31 as, on the contrary, happens in the systems of the known technique.

In addition, the device 1 maintains high processing efficiency while reducing the complexity of installation and maintenance of the system 1.

Installation of system 1 is extremely simple and facilitated, and the quantity of components is reduced to a minimum.

In addition, the system 1 is easily converted for making different types of non-woven fabrics as the conversion is completed by simply replacing the box 3 within the housing 22.

The invention is susceptible to variations within the scope of the inventive concept as defined by the claims.

Within this scope, all details are substitutable by equivalent elements and the materials, shapes and dimensions can be any.

The invention claimed is:

1. A multi-row coaxial melt-blown system comprising:

a support including one or more first ducts configured to convey polymeric fluid parallel to a delivery direction and at least a second duct configured to convey air or gas, a box removably constrained to said support and including:

a plurality of acceleration ducts extending parallel to said delivery direction comprising tubes in fluid passage connection with said one or more first ducts and configured to distribute said polymeric fluid, first holes extending parallel to said delivery direction, centred and spaced with respect to said acceleration ducts along said delivery direction and configured to house each part of a respective said tube, second holes extending parallel to said delivery direction action and adapted to allow the passage of air or gas, and a slit extending transversely to said delivery direction between said acceleration ducts and said first holes in connection with fluid passage with said second holes, a mask removably constrained to one or more of said support and said box and including a plurality of third holes centred with respect to said first holes, communicating with said second holes and configured to house part of said tubes and to allow, at the same time, the passage of said air or gas around said tubes, wherein said support comprises a housing configured to contain said box, said slit extends into said box from side to side so as to be in fluid passage connection with said second duct and configured to convey said air or gas from said second duct to said second holes, said mask comprises a seat configured to accommodate said box, and said seat is delimited by two side panels positioned on opposite sides with respect to said delivery direction and protruding parallel to said delivery direction, and said box comprises at least two fissures configured to each house a side panel.

2. The system according to claim 1, wherein said second duct accesses to said housing transversely to said delivery direction.

3. The system according to claim 1, wherein said support comprises first constraint means configured to allow the constraint of said support to an extrusion head or said box and second constraint means configured to allow the constraining of said mask on said support and accessible at an opposite side of said support with respect to said first constraint means.

4. A conversion kit for multi-row coaxial melt-blown system comprising a system according to claim 1, comprising a plurality of boxes which can be replaced within said housing and comprising different quantities and/or different arrangements of said first holes, said tubes and said second holes.

5. An assembly process of a multi-row coaxial melt-blown system according to claim 1, comprising introducing said box into said housing by arranging said slit in fluid passage connection with at least one said second duct and said tubes in fluid passage connection with said one or more first ducts and positioning said box within said seat and constraining, after said introduction, said mask on said support by introducing each of said two side panels into one of said fissures to anchor said mask to said box.

6. A cleaning process of a multi-row coaxial melt-blown system according to claim 1, comprising:

removing said box from said housing, and investing said slit with pressurized air to remove dust deposited within said slit.

* * * * *